US010321220B1

(12) United States Patent
Huang

(10) Patent No.: US 10,321,220 B1
(45) Date of Patent: Jun. 11, 2019

(54) EARCUSHION WITH ACOUSTIC TUBE

(71) Applicant: Meng Huang, Guangdong (CN)

(72) Inventor: Meng Huang, Guangdong (CN)

(73) Assignee: Shengyuan Science and Technology (Shenzhen) Co., Ltd., Shenzhen, Guangdong (CN)

( * ) Notice: Subject to any disclaimer, the term of this patent is extended or adjusted under 35 U.S.C. 154(b) by 0 days.

(21) Appl. No.: 15/919,236

(22) Filed: Mar. 13, 2018

(30) Foreign Application Priority Data

Dec. 27, 2017 (CN) ..... 2017 1 1441806

(51) Int. Cl.
*H04R 1/10* (2006.01)
*H04R 1/28* (2006.01)

(52) U.S. Cl.
CPC ..... *H04R 1/1075* (2013.01); *H04R 1/1083* (2013.01); *H04R 1/2803* (2013.01); *H04R 2460/01* (2013.01); *H04R 2460/15* (2013.01)

(58) Field of Classification Search
CPC .. H04R 1/1075; H04R 1/1083; H04R 1/2803; H04R 2460/01; H04R 2460/15
See application file for complete search history.

(56) References Cited

U.S. PATENT DOCUMENTS 4,972,491 A * 11/1990 Wilcox, Jr. ..... H04M 1/05 379/430
6,148,821 A * 11/2000 Falco ..... A61F 11/08 128/864
9,036,851 B2 * 5/2015 Peng ..... H04R 1/1075 381/374
10,034,086 B2 * 7/2018 Sapiejewski ..... H04R 1/1083
2009/0190771 A1 * 7/2009 Sung ..... A61F 11/08 381/71.6
2011/0170730 A1 * 7/2011 Zhu ..... H04R 25/00 381/380
2012/0134524 A1 * 5/2012 Peng ..... H04R 1/1075 381/380
2015/0136148 A1 * 5/2015 Cheng ..... A61F 11/08 128/868
2016/0374595 A1 * 12/2016 Henriksen ..... A61B 5/12 600/559
2018/0199129 A1 * 7/2018 Zhao ..... H04R 1/10

FOREIGN PATENT DOCUMENTS

EP 440572 * 8/1991

* cited by examiner

*Primary Examiner* — Mohammad K Islam

(57) ABSTRACT

An earcushion with acoustic tube, comprising an earcushion body; the earcushion body is provided with a front acoustic cavity of speaker, the front acoustic cavity of speaker is provided with an acoustic tube, one end of the acoustic tube is arranged in the front acoustic cavity of speaker; the other end is connected with a resonant cavity, the volume of the resonant cavity is much greater than that of the acoustic tube, the resonant cavity is communicated with the outside atmosphere, the linear amplitude of the speaker vibration system may be increased and the system power may be improved, it can also improve the loop feedback environment.

1 Claim, 3 Drawing Sheets

EARCUSHION WITH ACOUSTIC TUBE

BACKGROUND OF THE INVENTION

1. Field of the Invention

The invention belongs to the field of the earcushion, specifically relating to an earcushion with acoustic tube.

2. Description of the Related Art

Headphones generally have Circumaural and Supra-aural, ear-ring means earcushions ring wrap around the ear, earcushions refers to the earcushions pressed against the ear. Regardless of the design of the frontal cavity of a otoscopic or earbud, the issue of sound leakage on the earcushions and ears needs to be considered. In the case of a sealed design, since the earcushions are closely coupled with the skin around the ear, the acoustic damping of the front sound cavity is too large to restrict the linear vibration of the loudspeaker diaphragm, causing the acoustic distortion to be too large and thus affecting the sound quality. However, if the earcushions are leak-proof design, excessive sound leakage can cause poor low-frequency performance of the earphone and affect the sound quality.

SUMMARY OF THE INVENTION

The invention provides an earcushion with acoustic tube to solve the problems proposed in the above-mentioned background art.

The invention solves the technical problems by adopting the following technical solutions:

An earcushion with acoustic tube, comprising an earcushion body; the earcushion body is provided with a front acoustic cavity of speaker, the front acoustic cavity of speaker is provided with an acoustic tube, one end of the acoustic tube is arranged in the front acoustic cavity of speaker; the other end is connected with a resonant cavity, the volume of the resonant cavity is much greater than that of the acoustic tube, the resonant cavity is communicated with the outside atmosphere.

Further, a mould hole butted with the acoustic tube is arranged on the plastic part of the earcushion body, the mould hole is connected to the resonant cavity, the resonant cavity is communicated with the outside.

The invention has the following beneficial effects:

The invention has the advantages of simple structure and convenient use, it can improve the ear pressure balance of the front acoustic cavity and improve the non-linear distortion of the loudspeaker diaphragm, it also can change the acoustic resistance in the tube by changing the length of the acoustic tube and adjust the low frequency response of the earphone and improve the sound quality; it also can improve noise reduction headphones loop feedback environment actively, and it is not easy to produce howling.

DETAILED DESCRIPTION OF THE PREFERRED EMBODIMENTS

The invention will be further described in detail below with reference to the drawings and specific embodiments.

Figure 1:
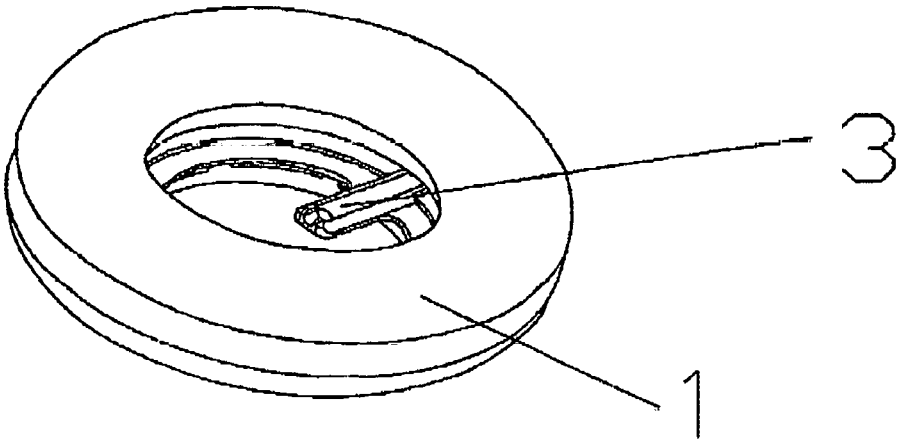
FIG. 1 is an overall structure diagram of an embodiment of the invention.
Figure 2:
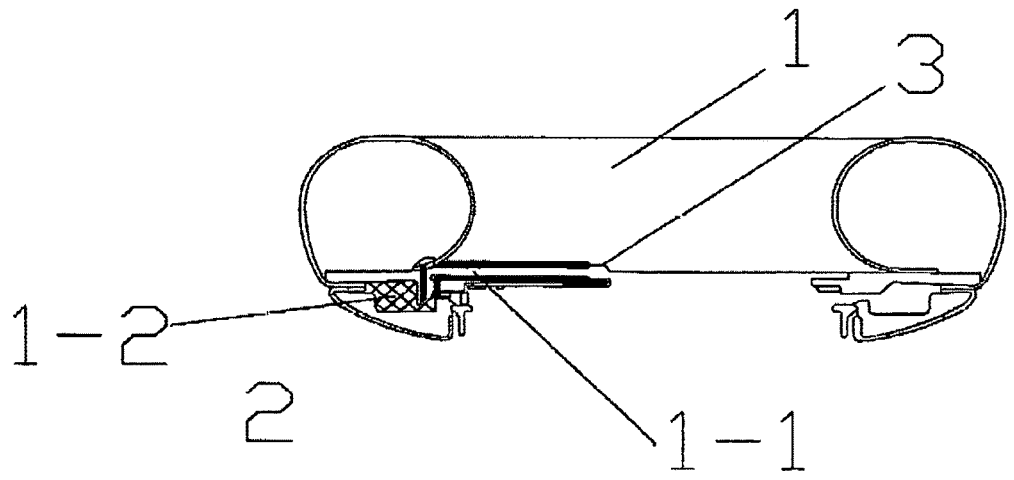
FIG. 2 is a schematic cross-sectional view of the earcushion and the acoustic tube of an embodiment of the invention.

Embodiment 1: as shown in FIGS. 1-2, the embodiment provides an earcushion with acoustic tube 3; the earcushion comprises an earcushion body 1; the earcushion body is provided with a front acoustic cavity of speaker 2; the front acoustic cavity of speaker 2 is provided with an acoustic tube 3; one end of the acoustic tube 3 is arranged in the front acoustic cavity of speaker 2; the other end is connected with a resonant cavity 1-2; the volume of the resonant cavity 1-2 is much greater than that of the acoustic tube 3; the resonant cavity 1-2 is communicated with the outside atmosphere; the earcushion body 1 can be separated from the earphone body; the acoustic tube 3 is embedded inside the earcushion body 1; the acoustic tube 3 is not connected to the earphone body 1; the bore diameter of the acoustic tube 3 is 0.8 mm-3.0 mm, and the length is 3 mm-30 mm; the acoustic tube 3 is sealed with the earcushion body in a glue sealing mode; a mould hole 1-1 butted with the acoustic tube 3 is arranged on the plastic part of the earcushion body; the mould hole 1-1 is connected to the resonant cavity 1-2; the resonant cavity 1-2 is communicated with the outside; the acoustic tube 3 is made of metal.

If the front acoustic cavity is of a low-leakage design, the diaphragm of speaker may be subjected to greater damping effect when vibrating. If the diaphragm of speaker is operated in high power, non-linear distortion easily occur.

Due to the existence of the acoustic tube 3 in the earcushion, the front sound cavity is communicated with the outside atmosphere, so that the linear amplitude of the speaker vibration system may be increased and the system power may be improved. The diaphragm of speaker may not be distorted during the vibrating process when the internal atmospheric pressure is consistent with the external atmospheric pressure. Since the internal and external atmospheric pressures are consistent, excessive pressure may not occur in the ear canal, thus improving the wearing comfort.

Figure 3:
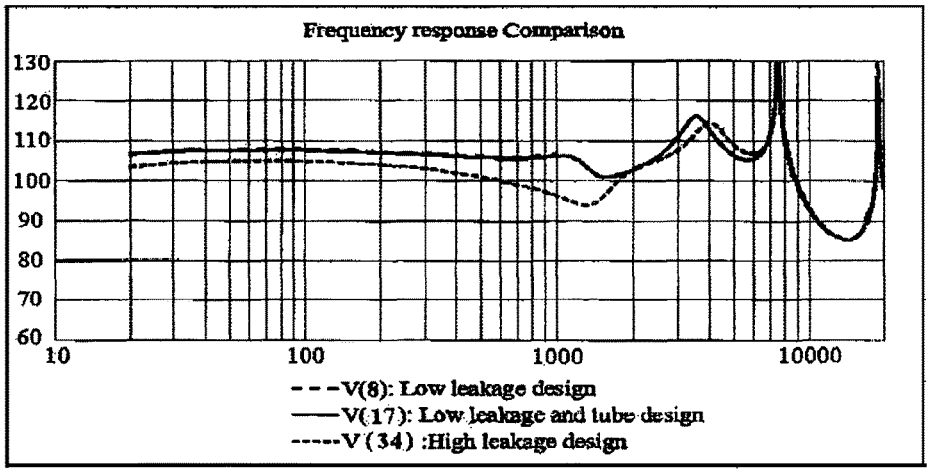
FIG. 3 is a comparison diagram of low-frequency characteristics of a low-leakage headset, a high-leakage headset and an earphone with the acoustic tube design.

When a low-leakage headset is worn, the earcushion should be well coupled with ears to reduce the sound leakage. The design of the earcushion with acoustic tube 3 may change the acoustic resistance in the acoustic tube by changing the length of acoustic tube 3, to adjust the low-frequency response of the earphone. As shown in FIG. 3, V (17) is a design of an earcushion with a 20 mm*1.8 mm (length*inner diameter) acoustic tube 3. Due to the acoustic resistance in the acoustic tube, the simulated frequency response curve is similar to that of the low-leakage earcushion V (8), and the frequency response of the high-leakage earcushion V (34) decreases.

For the feedback active noise-canceling earphone, the loop feedback from the speaker to the microphone easily leads to howling due to the closed design of the front acoustic cavity. The design of an earcushion with an acoustic tube 3 just improves the loop feedback environment, and it is not easy to produce howling.

What is claimed is:

1. An earcushion with acoustic tube, comprising an earcushion body; the earcushion body is provided with a front acoustic cavity of speaker, the front acoustic cavity of speaker is provided with an acoustic tube, one end of the acoustic tube is arranged in the front acoustic cavity of speaker; the other end is connected with a resonant cavity, the volume of the resonant cavity is much greater than that of the acoustic tube, the resonant cavity is communicated with the outside atmosphere, the bore diameter of the acoustic tube is 0.8 mm-3.0 mm, and the length is 3 mm-30 mm, the earcushion with acoustic tube wherein a mould hole butted with the acoustic tube is arranged on the plastic part of the earcushion body, the mould hole is connected to the resonant cavity, the resonant cavity is communicated with the outside.

* * * * *